US010927606B2

(12) United States Patent
Wan et al.

(10) Patent No.: US 10,927,606 B2
(45) Date of Patent: Feb. 23, 2021

(54) SEDIMENT CORE-DRILLING PROCESS FOR SUBMARINE WIRE-LINE CORING DRILL RIG

(71) Applicant: Hunan University of Science and Technology, Hunan (CN)

(72) Inventors: Buyan Wan, Hunan (CN); Yongping Jin, Hunan (CN); Xiaojun Huang, Hunan (CN); Jialiang Wang, Hunan (CN)

(73) Assignee: Hunan University of Science and Technology, Xiangtan (CN)

( * ) Notice: Subject to any disclaimer, the term of this patent is extended or adjusted under 35 U.S.C. 154(b) by 0 days.

(21) Appl. No.: 16/731,060

(22) Filed: Dec. 31, 2019

(65) Prior Publication Data

US 2020/0131853 A1 Apr. 30, 2020

Related U.S. Application Data

(63) Continuation of application No. PCT/CN2019/080692, filed on Mar. 30, 2019.

(30) Foreign Application Priority Data

Aug. 13, 2018 (CN) ..... 201810914274.X

(51) Int. Cl.
*E21B 7/124* (2006.01)
*E21B 21/00* (2006.01)
*E21B 25/18* (2006.01)

(52) U.S. Cl.
CPC ..... *E21B 7/124* (2013.01); *E21B 21/001* (2013.01); *E21B 25/18* (2013.01)

(58) Field of Classification Search
CPC ..... E21B 7/124; E21B 21/001; E21B 25/18
See application file for complete search history.

(56) References Cited

U.S. PATENT DOCUMENTS 2,176,477 A * 10/1939 Varney ..... E21B 25/18 175/6
3,491,842 A * 1/1970 Castela ..... E21B 7/124 175/6

(Continued)

FOREIGN PATENT DOCUMENTS

CN 105239947 A 1/2016
CN 105715221 A 6/2016

(Continued)

*Primary Examiner* — Aaron L Lembo

(57) ABSTRACT

Disclosed is a sediment core-drilling process for a submarine wire-line coring drill rig, including 1) lowering the drill rig; 2) drilling in a pressure-suction mode; 3) drilling in a rotation-pressure-suction mode; 4) cutting sediment cores; 5) recovering a core inner tube; 6) cleaning bottom of hole; 7) punching before adding a drill pipe; 8) lowering another core inner tube; 9) adding the drill pipe; 10) punching after adding the drill pipe; 11) repeating the steps 2)-10) until a given hole depth is reached; 12) recovering the drill pipe and a wire-line coring outer tube drilling tool; 13) recovering the submarine wire-line coring drill rig. The core-drilling process provided herein is suited to working conditions without mud lubrication and mud protection for hole wall. This invention has advantages of low disturbance and high efficiency in coring and is suitable for remote operation.

5 Claims, 2 Drawing Sheets

(56) References Cited

U.S. PATENT DOCUMENTS

| | | | | |
|---|---|---|---|---|
| 3,741,320 | A * | 6/1973 | Hilfing | E21B 19/002 175/6 |
| 6,394,192 | B1 * | 5/2002 | Frazer | E21B 7/124 175/58 |
| 6,457,526 | B1 * | 10/2002 | Dailey | E21B 7/124 166/338 |
| 7,918,287 | B2 * | 4/2011 | Foley | E21B 7/124 175/20 |
| 9,322,220 | B2 * | 4/2016 | Innes | E21B 15/02 |

FOREIGN PATENT DOCUMENTS

| | | | |
|---|---|---|---|
| CN | 106351597 | A | 1/2017 |
| JP | 2001234686 | A | 8/2001 |

* cited by examiner

SEDIMENT CORE-DRILLING PROCESS FOR SUBMARINE WIRE-LINE CORING DRILL RIG

CROSS-REFERENCE TO RELATED APPLICATIONS

This application is a continuation of International Patent Application No. PCT/CN2019/080692, filed on Mar. 30, 2019, which claims the benefit of priority from Chinese Application No. 2018109134274.X, filed on Aug. 13, 2018. The content of the aforementioned applications, including any intervening amendments thereto, are incorporated herein by reference.

TECHNICAL FIELD

The application relates to a sediment core-drilling process for a submarine wire-line coring drill rig.

BACKGROUND OF THE INVENTION

A submarine wire-line coring drill rig is always required in marine geological research, mineral resource exploration and subsea engineering survey. The submarine wire-line coring drill rig refers to a type of large-scale drill rig that a rig body is lowered to the seafloor from a mother ship through armoured umbilical cables, and the submarine wire-line core-drilling is performed through remote control of an operator on the deck. Compared to conventional land rigs or large offshore drillship rigs, the submarine wire-line coring drill rig has the advantages of low power consumption, high mobility, good coring quality and high-efficient operation.

In submarine sedimentary stratum core-drilling, the submarine wire-line coring drill rig differs from the conventional land rigs or the large offshore drillship rigs in the wire-line coring process, including:

(1) The conventional land rigs or the large offshore drillship rigs adopt mud as a flushing liquid during punching. The mud offers great protection to the hole wall, and has a strong ability to carry rock powder. However, the submarine wire-line coring drill rig cannot carry mud and other auxiliary equipment, considering the limits of size and weight of the rig. So the submarine wire-line coring drill rig often uses seawater as the flushing liquid, which forces the submarine wire-line coring drill rig to adopt different punching modes to accomplish the punching while minimizing the impact on hole wall.

(2) Without the mud protection for hole wall, and with the use of seawater for punching, the submarine wire-line coring drill rig is more likely to be exposed to a risk of hole collapse than the conventional land rigs or the large offshore drillship rigs, and faces a risk that a new wire-line coring inner tube cannot be placed in the correct place after being lowered. This risk is invisible and hard to be monitored and remedied. Therefore, the punching should be performed again after lowering the new wire-line coring inner tube and adding a new drill pipe to ensure that the following drilling is performed smoothly.

(3) The submarine wire-line coring drill rig can be remotely controlled and has high degree of automation. Facing drilling accidents, it is hard to carry out artificial intervention and treatment (such as the add and removal of drill pipes as well as the recovery and placement of wire-line coring inner pipes) for the submarine wire-line coring drill rig, but it is easy for the conventional land rigs or the large offshore drillship rigs. Therefore, the drilling process of the submarine wire-line coring drill rig requires a higher level in safety and reliability.

Due to the unique features of the submarine wire-line coring drill rig, the standard drilling procedures of the conventional land rigs or the large offshore drillship rigs fail to match the operating conditions of the submarine wire-line coring drill rig. An improved core-drilling process is required to match the unique features and the operating conditions of the submarine wire-line coring drill rig.

SUMMARY OF THE INVENTION

To solve the technical problems above, this invention provides a sediment core-drilling process for a submarine wire-line coring drill rig, which has advantages of low disturbance and high efficiency in coring, and is suitable for remote operation.

The technical solutions of the invention are described as follows.

A sediment core-drilling process for a submarine wire-line coring drill rig, comprising:

(1) arranging a plurality of drill pipes and a plurality of inner tubes on a storage rack of a drill rig; placing an inner tube that is hollow into an outer tube drilling tool; lifting the drill rig into the sea; leveling and supporting the drill rig by leveling-feet below the drill rig after the drill rig arrives at a surface of seabed sediments;

(2) switching a reversing valve to allow an inlet of a rodless cavity of a seawater suction cylinder to communicate with an inner hole of a drill pipe; keeping the drill rig to drill in a pressure-suction mode; passing force from a drilling power head to the drill pipe and the outer tube drilling tool to drive a thin-walled annular cutting blade at a font of the inner tube to cut into seabed sediments at a speed of 20±2 mm/s; and drawing seawater from the drill pipe by the seawater suction cylinder, wherein a volume of the drawn seawater is equal to a volume of a sediment core sample in the inner tube;

(3) switching on the drilling power head when a propulsive force of the drilling power head is not enough to drive the thin-walled annular cutting blade to cut into the seabed sediments at a reasonable speed only by pressure; drilling and cutting into the seabed sediments under the conditions that the outer tube drilling tool is driven by the drill pipe to rotate and the inner tube is kept from rotating;

(4) raising the drilling power head to take the drill pipe, the outer tube drilling tool and the inner tube up to a position where the inner tube is able to be removed; cutting sediment cores;

(5) using a winch to lower an extractor; recovering the inner tube containing the sediment core sample to the drill rig; separating an active drill pipe of the drilling power head from the drill pipe which is arranged below the active drill pipe; raising the active drill pipe to a highest position; placing the inner tube containing the sediment core sample on the storage rack of the drill rig;

(6) reconnecting the active drill pipe to the drill pipe which is arranged below the active drill pipe; switching the reversing valve to allow a water outlet of a pump to communicate with the inner hole of the drill pipe; switching on the pump and the drilling power head; cleaning a bottom of the drilled hole by using the outer tube drilling tool to wipe stairs at the bottom of the drilled hole, wherein the stairs are formed since the inner tube protrudes from the outer tube drilling tool;

(7) using the pump to repeatedly perform punching; wherein the punching is performed by raising the drilling power head to take the drill pipe and the outer tube drilling tool up 1.5-2.0 m from the bottom of the drilled hole followed by staying for 20-30 s and returning to the bottom of the drilled hole;

(8) separating the active drill pipe from the drill pipe; raising the active drill pipe to the highest position; lowering another inner pipe that is hollow into the outer tube drilling tool;

(9) adding another drill pipe;

(10) using the pump to repeatedly perform punching;

(11) performing one or both of the steps (7) and (10) as needed; determining if the core-drilling reaches a given hole depth; if yes, proceeding to next step; if no, repeating the steps (2)-(10);

(12) recovering the drill pipe and the outer tube drilling tool; and

(13) recovering the drill rig;

wherein the drill pipes, the inner tubes, the drill rig and the outer tube drilling tool are suitable for submarine wire-line coring; the sediment core-drilling process adopts a coring apparatus, which comprises the drill rig, the plurality of drill pipes, the plurality of inner tubes and the outer tube drilling tool; the drill rig is provided with the pump, the seawater suction cylinder and the reversing valve; the pump is specifically a high pressure seawater washing pump; the water outlet of the pump and the inlet of the rodless cavity of the seawater suction cylinder are communicated with an inner hole of the active drill pipe on the drilling power head of the drill rig via the reversing valve; the reversing valve is switchable as needed to allow the inner hole of the drill pipe to communicate with the water outlet of the pump or the inlet of the rodless cavity of the seawater suction cylinder; a rod cavity of the seawater suction cylinder is communicated with external seawater; a top end of a first piston rod of the seawater suction cylinder is connected to a top end of a second piston rod of a propulsion cylinder of the drill rig via hinges; an upper part of the inner tube is provided with a bearing combination which prevents a rotational motion of the outer tube drilling tool from being transmitted to the inner tube; the thin-walled annular cutting blade is provided at a bottom of the inner tube; the inner tube and the outer tube drilling tool are matched in a way that a part of the inner tube outwardly protrudes from a center hole of the outer tube drilling tool, and the inner tube and the center hole of the outer tube drilling tool are arranged with clearance.

In step (2) of the sediment core-drilling process, the drilling is performed in the pressure-suction mode at a drilling speed of 20±2 mm/s.

In step (3) of the sediment core-drilling process, the drilling power head starts to rotate when a propulsive force of the drilling power head achieves 60-80% of its own maximum propulsive force, or is 3-4 tons; and the drilling power head rotates at a rotational speed of 30-150 r/min and performs the drilling at a drilling speed of 20±2 mm/s.

In step (5) of the sediment core-drilling process, the winch lowers the extractor at a lowering speed of 18-25 m/min; and the winch and the extractor are lifted to raise the inner tube at an ascending speed of 30-40 m/min.

In step (6) of the sediment core-drilling process, the outer tube drilling tool cleans the bottom of the drilled hole at a speed of 20-25 m/min; and the pump functions for 1-2 min at a pump flow rate of 50-80 L/min.

In step (7) of the sediment core-drilling process, the punching is performed for 2-3 times when a drilling depth is less than 10 m, 3-4 times when the drilling depth is 10-30 m, or more than 5 times when the drilling depth is more than 30 m; and a pump flow rate of the pump is 50-80 L/min during a downwards punching, and 100-150 L/min during an upwards punching;

In step (10) of the sediment core-drilling process, the punching is performed for 1-2 times when the drilling depth is less than 10 m, 2-3 times when the drilling depth is 10-30 m, or 4 times when the drilling depth is more than 30 m; the pump flow rate of the pump 1 is 100-150 L/min during the downwards punching and the upwards punching;

In step (3) of the sediment core-drilling process, after the drilling power head starts to rotate, if a propulsion force of the drilling power head is reduced to less than 2 tons, or less than 40% of its own maximum propulsive force, the drilling power head stops rotating, at this point, the drilling switches back to the pressure-suction mode in step (2).

Compared to the prior art, this invention has the following beneficial effects.

(1) The invention is suited to working conditions without mud lubrication and mud protection for hole wall.

(2) The invention has advantages of low disturbance and high efficiency in coring, and is suitable for remote operation.

Figure 1:
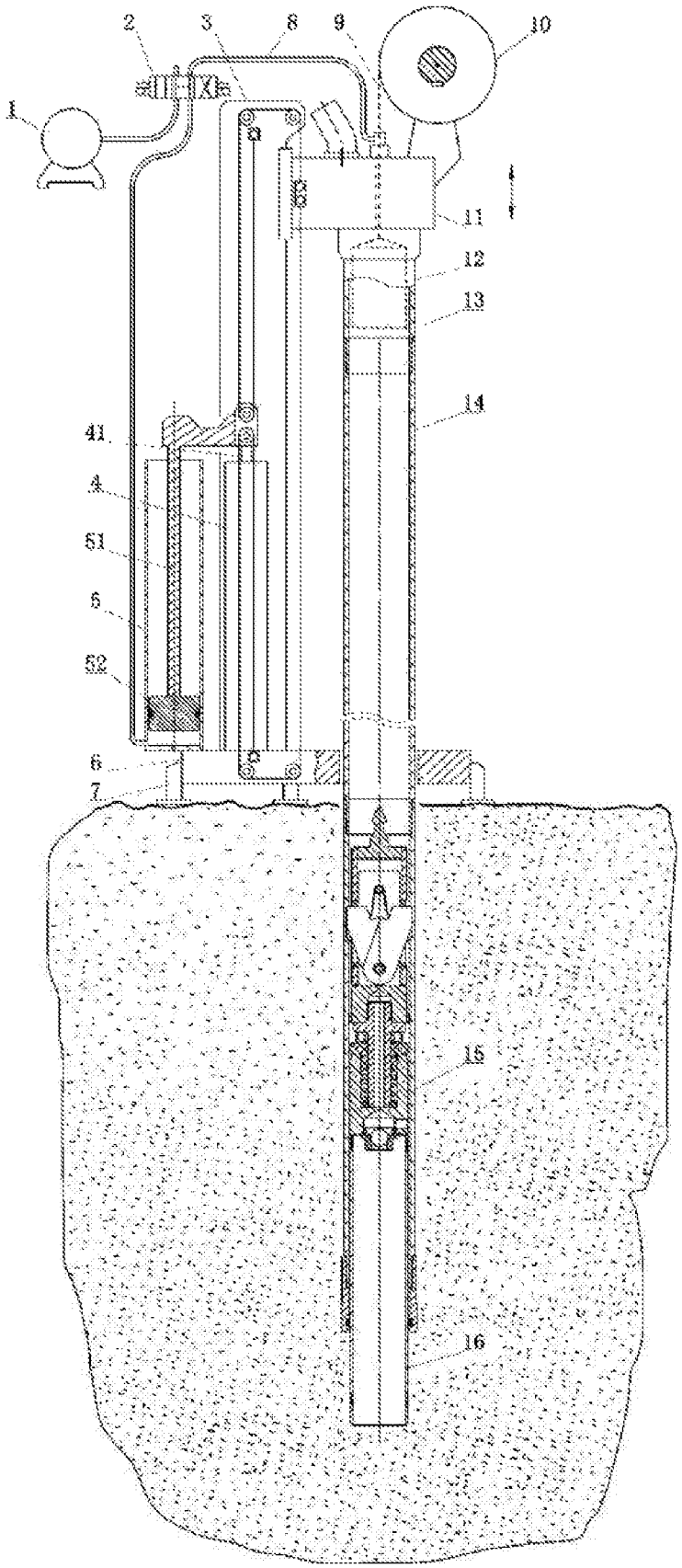
FIG. 1 is a schematic diagram of a coring apparatus in the invention.

In the drawings: 1—pump; 2—reversing valve; 3—slide rail frame; 4—propulsion cylinder; 41—second piston rod; 5—seawater suction cylinder; 51—first piston rod; 52—seawater cylinder piston; 6—base; 7—leveling foot; 8—water pipe; 9—steel wire rope; 10—winch; 11—drilling power head; 12—extractor; 13—active drill pipe; 14—drill pipe; 15—outer tube drilling tool; 16—inner tube; 161—bearing combination; and 162—thin-walled annular cutting blade.

DETAILED DESCRIPTION OF EMBODIMENTS

The invention will be further described below with reference to the accompanying drawings.

Figure 2:
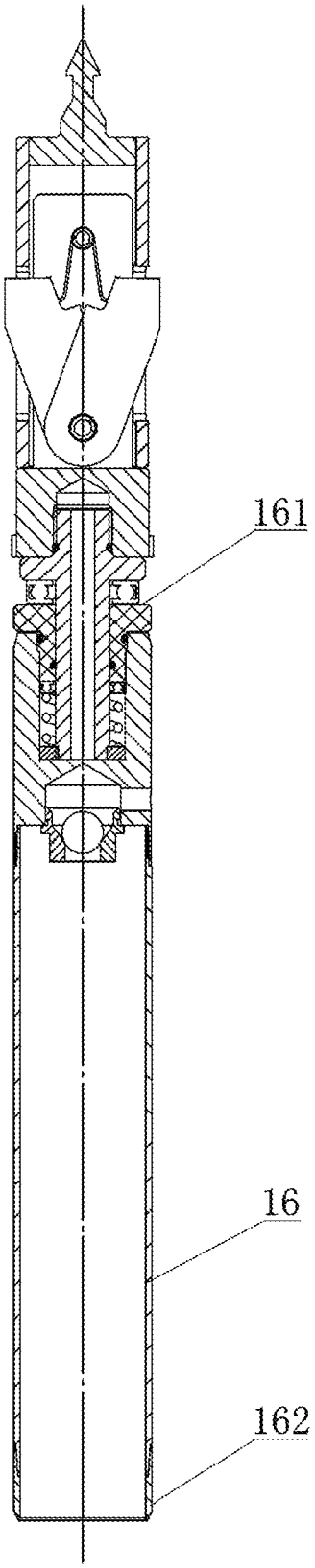
FIG. 2 is a schematic diagram of a wire-line coring inner tube in the invention.

As shown in FIGS. 1 and 2, a coring apparatus in the invention includes a drill rig, a plurality of drill pipes 14, a plurality of inner tubes 16 and an outer tube drilling tool 15. The drill pipes, the inner tubes, the drill rig and the outer tube drilling tool are suitable for submarine wire-line coring. The drill rig is provided with a pump 1, a seawater suction cylinder 5, and a reversing valve 2. The pump 1 is specifically a high pressure seawater washing pump. A water outlet of the pump 1 and an inlet of a rodless cavity of the seawater suction cylinder 5 are communicated with an inner hole of an active drill pipe 13 on a drilling power head 11 of the drill rig via the reversing valve 2. An inner hole of a drill pipe 14 is communicated with the water outlet of the pump 1 or the inlet of the rodless cavity of the seawater suction cylinder 5 through the switch of the reversing valve 2 as needed. A rod cavity of the seawater suction cylinder 5 is communicated with external seawater. A top end of a first piston rod 51 of the seawater suction cylinder is connected to a top end of a second piston rod 41 of a propulsion cylinder of the drill rig via hinges, so that the seawater suction cylinder 5 and the propulsion cylinder 4 of the drill rig move synchronously. An upper part of an inner tube 16 is provided with a bearing combination 161 which prevents a rotational motion of the outer tube drilling tool 15 from being transmitted to the inner tube 16. A thin-walled annular cutting blade 162 is provided at a bottom of the inner tube 16. The inner tube 16 and the outer tube drilling tool 15 are matched in a way that a front part of the inner tube 16 outwardly protrudes from a center hole of a drill bit of the outer tube drilling tool 15 for a distance, and the distance is generally between 100-500 mm, and the inner tube 16 and the center hole of the drill bit of the outer tube drilling tool 15 are arranged with clearance. The propulsion cylinder 4, the seawater suction cylinder 5 and a slide rail frame 3 are provided on a base 6. A vertical slide rail is provided on one side of the slide rail frame 3. The drilling power head 11 is provided on the vertical slide rail and able to move along the vertical slide rail. A plurality of leveling feet 7 are provided at a bottom of the base 6. A first pulley and a second pulley are provided at an upper end of the second piston rod 41, and the first pulley is arranged above the second pulley. A top and a bottom of the slide rail frame 3 are respectively provided with upper pulleys and lower pulleys. An end of an upper steel wire rope of the slide rail frame 3 is fixedly connected to the top of the slide rail frame 3. The other end of the upper steel wire rope sequentially wraps around the first pulley at the upper end of the second piston rod 41 and the upper pulleys at the top of the slide rail frame 3 and then is connected to the drilling power head 11. An end of a lower steel wire rope of the slide rail frame 3 is fixedly connected to the bottom of the slide rail frame 3. The other end of the lower steel wire rope of the slide rail frame 3 sequentially wraps around the second pulley at the upper end of the second piston rod 41 and the lower pulleys at the bottom of the slide rail frame 3 and then is connected to the drilling power head 11. The drilling power head 11 is provided with the active drill pipe 13 which can be connected to an upper end of the drill pipe 14 or an upper end of the outer tube drilling tool 15 via screw threads. A lower end of the drill pipe 14 can be connected to the upper end of the outer tube drilling tool 15 via screw threads. The drilling power head 11 is provided with a hole which is communicated to the active drill pipe 13. An extractor 12 is provided inside the active drill pipe 13. An end of a steel wire rope of a winch 10 is connected to the extractor 12, and the other end of the steel wire rope of the winch 10 is connected to the winch 10 through the hole of the drilling power head 11.

A sediment core-drilling process for a submarine wire-line coring drill rig provided in the invention includes the following steps.

(1) Lowering a Drill Rig

Firstly, a plurality of drill pipes 14 and a plurality of inner tubes 16 are arranged on a storage rack of a drill rig. An inner tube 16 that is hollow is placed into an outer tube drilling tool 15, and then the drill rig is hung into the sea. When the drill rig arrives at a surface of seabed sediments, the drill rig is leveled and supported by leveling feet 7 below the drill rig. Where the drill pipes, the inner tubes, the drill rig and the outer tube drilling tool are suitable for submarine wire-line coring.

(2) Core-Drilling in a Pressure-Suction Mode

The drill rig adopts the pressure-suction mode for core-drilling. An inlet of a rodless cavity of a seawater suction cylinder 5 is communicated with an inner hole of a drill pipe 14 through a reversing valve 2. The drilling power head 11 passes force to the drill pipe 14 and the outer tube drilling tool 15 to drive a thin-walled annular cutting blade 162 at a font of the inner tube 16 to cut into seabed sediments at a speed of 20±2 mm/s. Simultaneously, the seawater suction cylinder 5 draws seawater from the drill pipe 14, where a volume of the drawn seawater is equal to a volume of a sediment core sample in the inner tube 16.

(3) Core-Drilling in a Rotation-Pressure-Suction Mode

When a propulsive force of the drilling power head 11 is not enough to drive the thin-walled annular cutting blade 162 to cut into the seabed sediments at a reasonable speed in the pressure-suction mode, that is, when the propulsive force of the drilling power head 11 achieves 60-80% of its own maximum propulsive force, or is 3-4 tons, the drilling power head 11 starts to rotate while continuing the downward drilling. A rotational speed of the drilling power head 11 is 30-150 r/min, and a drilling speed of the drilling power head 11 is 20±2 mm/s. The drill pipe 14 drives the outer tube drilling tool 15 to rotate, and a bearing combination 161 on an upper portion of the inner tube 16 keeps the inner tube 16 from rotating while the inner tube 16 continues cutting into the seabed sediments.

After the drilling power head starts to rotate, if a propulsion force of the drilling power head 11 is reduced to less than 2 tons, or less than 40% of its own maximum propulsive force, the drilling power head 11 stops rotating, at this point, the drilling switches back to the pressure-suction mode in step (2).

(4) Cutting Sediment Cores

The drilling power head 11 is lifted to take the drill pipe 14, the outer tube drilling tool 15 and the inner tube 16 to a position where the inner tube can be removed. Simultaneously sediment cores are cut.

(5) Recovery of the Inner Tube

An extractor 12 is lowered by using a winch 10 to recover the inner tube 16 to the drill rig, where the inner tube 16 inside the outer tube drilling tool 15 contains the sediment core sample. An active drill pipe 13 of the drilling power head is separated from the drill pipe 14 which is arranged below the active drill pipe, and the active drill pipe 13 is raised to a highest position. A manipulator places the inner tube containing the sediment core sample on the storage rack of the drill rig. The winch 10 lowers the extractor 12 at a lowering speed of 18-25 m/min. The winch 10 and the extractor 12 are lifted to raise the inner tube 16 at an ascending speed of 30-40 m/min.

(6) Cleaning a Bottom of the Drilled Hole

The active drill pipe 13 is reconnected to the drill pipe 14 which is arranged below the active drill pipe. A water outlet of a pump 1 is communicated with an inner hole of the drill pipe 14 through the switch of the reversing valve 2. The pump 1 is switched on to perform washing using seawater under high pressure, and the drilling power head 11 starts to rotate. The outer tube drilling tool 15 cleans the bottom of the drilled hole at a speed of 20-25 m/min. The pump 1 functions for 1-2 min at a pump flow rate of 50-80 L/min.

(7) Punching Before Adding Another Drill Pipe

The pump 1 is used to repeatedly perform punching. The punching is performed by raising the drilling power head 11 to take the drill pipe 14 and the outer tube drilling tool 15 up 1.5-2.0 m from the bottom of the drilled hole followed by staying for 20-30 s and returning to the bottom of the drilled hole. The punching is performed for 2-3 times when a drilling depth is less than 10 m, 3-4 times when the drilling depth is 10-30 m, or more than 5 times when the drilling depth is more than 30 m. A pump flow rate of the pump 1 is 50-80 L/min during a downwards punching, and is 100-150 L/min during an upwards punching.

(8) Lowering Another Inner Tube

The active drill pipe 13 is separated from the drill pipe 14 and raised to the highest position. Another inner pipe 16 that is hollow is lowered into the outer tube drilling tool 15 through the cooperation of the manipulator, the extractor 12 and the winch 10.

(9) Another Drill Pipe 14 is Added.

(10) Punching after Adding the Drill Pipe

The pump 1 is re-used to repeatedly perform punching at large flow rate. The punching is performed by raising the drilling power head 11 to take the drill pipe 14 and the outer tube drilling tool 15 up 1.5-2.0 m from the bottom of the drilled hole followed by staying for 20-30 s and returning to the bottom of the drilled hole. The punching is performed for 1-2 times when the drilling depth is less than 10 m, 2-3 times when the drilling depth is 10-30 m, or 4 times when the drilling depth is more than 30 m. The pump flow rate of the pump 1 is 100-150 L/min during the downwards punching and the upwards punching of the outer tube drilling tool 15.

(11) One or Both of the Steps (7) and (10) are Performed as Needed. It is required to determine if the core-drilling reaches a given hole depth. If yes, next step can be performed; if no, the steps (2)-(10) are repeated.

(12) Recovery of the Drill Pipes and the Outer Tube Drilling Tool

The drilling power head 11 is lifted to take the drill pipe 14 and the outer tube drilling tool 15 to a position where the drill pipe 14 can be removed. The active drill pipe 13 is separated from the drill pipe 14 and raised to the highest position. The manipulator places the drill pipe 14 on the storage rack of the drill rig. The drilling power head 11 is lowered to connect to another drill pipe 14. Then the drilling power head 11 is lifted to take the drill pipe 14 and the outer tube drilling tool 15 to the position where the drill pipe 14 can be removed. The active drill pipe 13 is separated from the drill pipe 14 and raised to the highest position. The manipulator places the drill pipe 14 on the storage rack of the drill rig. The operations are repeated until all the drill pipes 14 are recovered. The drilling power head 11 is lowered to connect to the outer tube drilling tool 15, and then lifted to take the outer tube drilling tool 15 to a position where the outer tube drilling tool 15 can be removed. The active drill pipe 13 is separated from the outer tube drilling tool 15 and raised to the highest position. The manipulator places the outer tube drilling tool 15 on the storage rack of the drill rig.

(13) Recovery of the Drill Rig

The drill rig is recovered to a mother ship.

What is claimed is:

1. A sediment core-drilling process for a submarine wire-line coring drill rig, comprising:

(1) arranging a plurality of drill pipes and a plurality of inner tubes on a storage rack of a drill rig; placing an inner tube that is hollow into an outer tube drilling tool; lifting the drill rig into the sea; leveling and supporting the drill rig by leveling-feet below the drill rig after the drill rig arrives at a surface of seabed sediments;

(2) switching a reversing valve to allow an inlet of a rodless cavity of a seawater suction cylinder to communicate with an inner hole of a drill pipe; keeping the drill rig to drill in a pressure-suction mode; passing force from a drilling power head to the drill pipe and the outer tube drilling tool to drive a thin-walled annular cutting blade at a front of the inner tube to cut into the seabed sediments at a speed of 20±2 mm/s; and drawing seawater from the drill pipe by the seawater suction cylinder, wherein a volume of the drawn seawater is equal to a volume of a sediment core sample in the inner tube;

(3) switching on the drilling power head when a propulsive force of the drilling power head is not enough to drive the thin-walled annular cutting blade to cut into the seabed sediments at a speed only by pressure; drilling and cutting into the seabed sediments under conditions that the outer tube drilling tool is driven by the drill pipe to rotate and the inner tube is kept from rotating;

(4) raising the drilling power head to take the drill pipe, the outer tube drilling tool and the inner tube up to a position where the inner tube is able to be removed;

cutting sediment cores;

(5) using a winch to lower an extractor; recovering the inner tube containing the sediment core sample to the drill rig; separating an active drill pipe of the drilling power head from the drill pipe which is arranged below the active drill pipe; raising the active drill pipe to a highest position; placing the inner tube containing the sediment core sample on the storage rack of the drill rig;

(6) reconnecting the active drill pipe to the drill pipe which is arranged below the active drill pipe; switching the reversing valve to allow a water outlet of a pump to communicate with the inner hole of the drill pipe; switching on the pump and the drilling power head; cleaning a bottom of the drilled hole by using the outer tube drilling tool to wipe stairs at the bottom of the drilled hole, wherein the stairs are formed since the inner tube protrudes from the outer tube drilling tool;

(7) using the pump to repeatedly perform punching; wherein the punching is performed by raising the drilling power head to take the drill pipe and the outer tube drilling tool up 1.5-2.0 m from the bottom of the drilled hole followed by staying for 20-30 s and returning to the bottom of the drilled hole; the punching is performed for 2-3 times when a drilling depth is less than 10 m, 3-4 times when the drilling depth is 10-30 m, or more than 5 times when the drilling depth is more than 30 m; and a pump flow rate of the pump is 50-80 L/min during a downwards punching, and 100-150 L/min during an upwards punching;

(8) separating the active drill pipe from the drill pipe; raising the active drill pipe to the highest position; lowering another inner pipe that is hollow into the outer tube drilling tool;

(9) adding another drill pipe;

(10) using the pump to repeatedly perform punching, wherein the punching is performed for 1-2 times when the drilling depth is less than 10 m, 2-3 times when the drilling depth is 10-30 m, or 4 times when the drilling depth is more than 30 m; the pump flow rate of the pump is 100-150 L/min during the downwards punching and the upwards punching;

(11) performing one or both of the steps (7) and (10) as needed; determining if the core-drilling reaches a given hole depth; if yes, proceeding to next step; if no, repeating the steps (2)-(10);

(12) recovering the drill pipe and the outer tube drilling tool; and

(13) recovering the drill rig;

wherein the drill pipes, the inner tubes, the drill rig and the outer tube drilling tool are suitable for submarine wire-line coring; the sediment core-drilling process adopts a coring apparatus, which comprises the drill rig, the plurality of drill pipes, the plurality of inner tubes and the outer tube drilling tool; the drill rig is provided with the pump, the seawater suction cylinder and the reversing valve; the pump is specifically a high pressure seawater washing pump; the water outlet of the pump and the inlet of the rodless cavity of the seawater suction cylinder are communicated with an inner hole of the active drill pipe on the drilling power head of the drill rig via the reversing valve; the reversing valve is switchable as needed to allow the inner hole of the drill pipe to communicate with the water outlet of the pump or the inlet of the rodless cavity of the seawater suction cylinder; a rod cavity of the seawater suction cylinder is communicated with external seawater; a top end of a first piston rod of the seawater suction cylinder is connected to a top end of a second piston rod of a propulsion cylinder of the drill rig via hinges; an upper part of the inner tube is provided with a bearing combination which prevents a rotational motion of the outer tube drilling tool from being transmitted to the inner tube; the thin-walled annular cutting blade is provided at a bottom of the inner tube; the inner tube and the outer tube drilling tool are matched in a way that a part of the inner tube protrudes out from a center hole of the outer tube drilling tool, and the inner tube and the center hole of the outer tube drilling tool are arranged with clearance.

2. The sediment core-drilling process of claim 1, wherein in step (3), the drilling power head starts to rotate when a propulsive force of the drilling power head is 60-80% of its own maximum propulsive force or is 3-4 tons; and the drilling power head rotates at a rotational speed of 30-150 r/min and performs the drilling at a drilling speed of 20±2 mm/s.

3. The sediment core-drilling process of claim 1, wherein in step (5), the winch lowers the extractor at a lowering speed of 18-25 m/min; and the winch and the extractor are lifted to raise the inner tube at an ascending speed of 30-40 m/min.

4. The sediment core-drilling process of claim 1, wherein in step (6), the outer tube drilling tool cleans the bottom of the drilled hole at a speed of 20-25 m/min; and the pump functions for 1-2 min at a pump flow rate of 50-80 L/min.

5. The sediment core-drilling process of claim 1, wherein in step (3), after the drilling power head starts to rotate, if a propulsion force of the drilling power head is reduced to less than 2 tons or less than 40% of its own maximum propulsive force, the drilling power head stops rotating and at this point the drilling switches back to the pressure-suction mode in step (2).

* * * * *